US008035021B2

(12) United States Patent
Shirahama et al.

(10) Patent No.: US 8,035,021 B2
(45) Date of Patent: Oct. 11, 2011

(54) TONE GENERATION APPARATUS

(75) Inventors: Taro Shirahama, Hamamatsu (JP); Tokio Shirakawa, Hamamatsu (JP); Shigematsu Fujita, Iwata (JP)

(73) Assignee: Yamaha Corporation, Hamamatsu-shi (JP)

( * ) Notice: Subject to any disclaimer, the term of this patent is extended or adjusted under 35 U.S.C. 154(b) by 24 days.

(21) Appl. No.: 12/729,070

(22) Filed: Mar. 22, 2010

(65) Prior Publication Data

US 2010/0236384 A1 Sep. 23, 2010

(30) Foreign Application Priority Data

Mar. 23, 2009 (JP) ..... 2009-069357

(51) Int. Cl.
*G10H 7/04* (2006.01)

(52) U.S. Cl. ..... 84/605

(58) Field of Classification Search ..... 84/605
See application file for complete search history.

(56) References Cited

U.S. PATENT DOCUMENTS 5,086,475 A * 2/1992 Kutaragi et al. ..... 704/265
5,442,126 A * 8/1995 Tokiharu ..... 84/603
5,463,183 A 10/1995 Konno
5,892,170 A 4/1999 Ichiki et al.
6,473,847 B1 * 10/2002 Kamiya ..... 711/171
7,420,115 B2 9/2008 Kawamoto et al.
2002/0134222 A1 * 9/2002 Tamura ..... 84/622

FOREIGN PATENT DOCUMENTS

JP 2671747 4/1994
JP 3163984 1/1998
JP 4089687 7/2006

* cited by examiner

*Primary Examiner* — Jianchun Qin

(74) *Attorney, Agent, or Firm* — Morrison & Foerster LLP

(57) ABSTRACT

With no interrupt to a CPU, waveform data stored in a NAND-type flash memory are read out on a page-by-page basis to supply a buffer of a waveform memory with waveform sample data. A series of waveform data are prestored in successive pages of the intermediate buffer capable of high-speed page access thereto. Page number of a page to be read out first is set, and that page is read into a buffer in advance. Before completion of readout of the first page, another page to be read out next is loaded into the buffer. After that, the page number is incremented by one each time readout of one page is completed, and the waveform sample data of the page number continue to be reproduced while being read into the buffer.

10 Claims, 7 Drawing Sheets

TONE GENERATION APPARATUS

BACKGROUND

The present invention relates generally to tone generation apparatus of a waveform memory type, and more particularly to a tone generation apparatus in which waveform data are prestored in a NAND-type flash memory and the thus-prestored waveform data are reproduced while being read out from a waveform memory via a buffer.

Heretofore, there have been known tone generation apparatus, in which waveform data are prestored in a hard disk (HD) and then read out for audible reproduction by being read out from a buffer to a waveform memory while being read out from the hard disk to the buffer. Examples of such tone generation apparatus are disclosed in Japanese Patent Nos. 2671747 and 4089687. In such tone generation apparatus, where the waveform data are read out, in response to a tone generation instruction, from the hard disk to the waveform memory via the buffer and audibly reproduced, there would occur a delay in tone generation start timing, and thus, an arrangement is employed for pre-reading (pre-loading) a leading portion of the waveform data to the waveform data at the time of powering-on of the tone generation apparatus. Reproduction, of the pre-loaded data of the leading portion thus stored in the waveform memory is started immediately in response to a tone generation instruction. During the reproduction of the leading portion of the waveform data, a next portion of the waveform data following the leading portion is read out from the hard disk to the waveform memory via the buffer. After the reproduction of the leading portion of the waveform data is completed, the waveform data having already been read out to the waveform memory are reproduced, during which time another next portion of the waveform data is read out from the hard disk to the waveform memory via the buffer. Such operations are repeated to continue reproducing the waveform data. In the aforementioned manner, tone generation can be started with no delay in response to the tone generation instruction.

According to the aforementioned conventionally-known technique, a transfer request interrupt is issued to a CPU each time the waveform data (waveform sample data) of one cluster have been read out to the waveform memory (namely, each time the buffer gets empty). In response to such a transfer request interrupt, the CPU specifies another cluster of the hard disk to be read out and instructs a transfer section to transfer the other cluster from the hard disk to the buffer. Therefore, with the conventionally-known technique, an interrupt process by the CPU is essential.

Further, waveform memory tone generators using burst transfers have been known, one example of which is disclosed in Japanese Patent No 3163984. In the waveform memory tone generator, waveform samples read out from a and tones are generated by necessary waveform samples being selectively read out from the buffer memory. The readout of the waveform samples from the waveform memory to the buffer memory is executed by bust-transferring the waveform samples in units or blocks of a plurality of samples. Burst transferring the waveform samples like this can shorten a necessary access time.

In recent years, the NAND-type flash memory has been increasing in capacity and decreasing in cost, and attempts have been made to use NAND-type flash memories, together with hard disks, in a variety of devices. Although the NAND-type flash memory would take time to make immediate access to a page (corresponding to a cluster of the hard disk), it can achieve a rapid data transfer speed once sample readout is started. Further, with the NAND-type flash memory, error correction based on error correction code is essential.

With the aforementioned tone generation apparatus using the hard disk, an access speed to the hard disk would become a bottleneck so that the number of channels capable of simultaneously reproducing waveform sample data (i.e., generating tones based on waveform sample data) is limited, although there is a need for the tone generation apparatus to maximize the number of channels capable of simultaneously generating tones. One conceivable approach for maximizing the number of channels capable of simultaneously generating tones is to use a NAND-type flash memory in place of the hard disk. Because the NAND-type flash memory is much higher in access speed than the hard disk, it can greatly reduce a size of a cluster (page) (that is a minimum unit of waveform sample data), for example, to one-tenth or smaller. In such a case, however, the frequency of transfer request interrupts would greatly increase, for example, to ten times or more; namely, a load on the CPU would greatly increase.

However, with the conventionally-known technique, where the access speed to the hard disk would become a bottleneck, replacing the hard disk as-is with the NAND-type flash memory cannot be said to achieve a well-balanced design.

SUMMARY OF THE INVENTION

In view of the foregoing, it is an object of the present invention to reduce a load on a CPU and achieve a well-balanced design in a tone generation apparatus in which waveform data are prestored in a NAND-type flash memory and the thus-prestored waveform data are reproduced while being read out to a waveform memory via a buffer.

In order to accomplish the above-mentioned object, the present invention is characterized in that waveform sample data stored in a NAND-type flash memory or the like are read out on a page-by-page basis, i.e. in units of a page, with no interrupt given to a CPU, so that a buffer of a waveform memory can be supplied or replenished with waveform sample data. A series of waveform sample data are prestored in successive pages of the NAND-type flash memory or the like capable of high-speed page readout. The page number of a page to be read out first at the time of the start of tone generation, and the waveform sample data of that page are read into a buffer in advance. Before completion of readout of the first page, waveform samples data of another page to be read out next are read or loaded into the buffer. After that, the page number is incremented by one each time readout of one page is completed, and the waveform sample data of the incremented page number continue to be reproduced while being read into the buffer. Thus, every readout request generated following the start of tone generation can be processed with simple hardware without any interrupt being given to the CPU.

According to the present invention, page-by-page transfers by a transfer section can be automatically performed in response to an instruction form a transfer queue register without any interrupt being given to a control section (CPU). Thus, a load on the CPU can be reduced. In this way, the present invention can achieve a well-balanced design, taking into consideration bottlenecks of various sections that would occur when waveform sample data are to be transferred from the first memory to the second memory.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
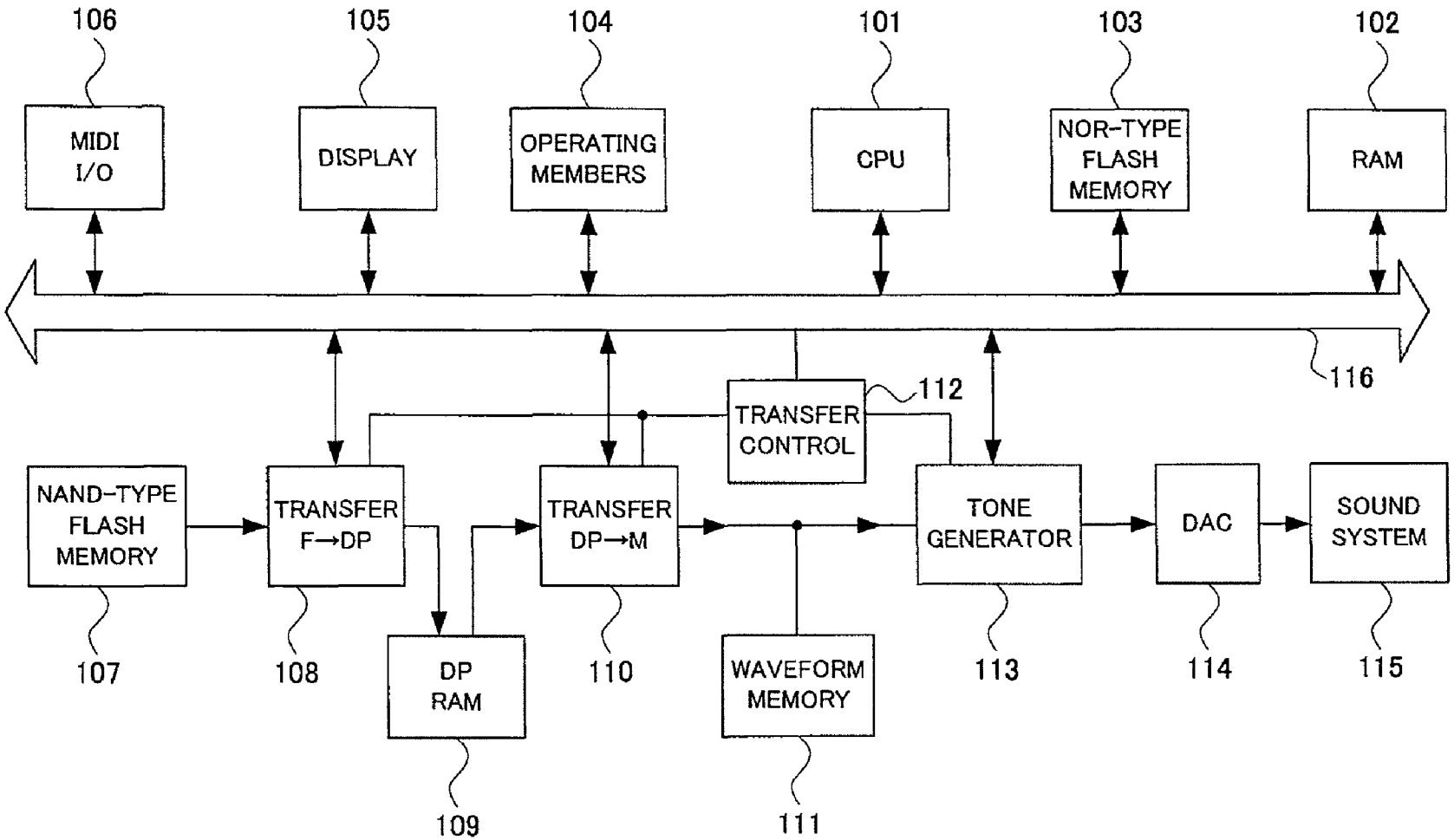
FIG. 1 is a block diagram showing an example overall setup of a tone generation system according to an embodiment of the present invention.

FIG. 1 is a block diagram showing an example overall setup of a tone generation apparatus or system according to an embodiment of the present invention. This tone generation apparatus may be implemented by a general-purpose personal computer (PC) with a soundboard mounted thereto, or constructed as a dedicated apparatus, such as an electronic musical instrument rather than a general-purpose PC, which is arranged to generate tone signals.

In FIG. 1, a CPU 101 is a processing device for control overall operation of the tone generation apparatus. A random access memory (RAM) 102 is a volatile memory for use as a loading area for loading therein programs to be execute by the CPU 101 and as a working area to be used by the CPU 101. A NOR-type flash memory 103 is a rewritable non-volatile memory having stored therein programs, such as an initial program loader, and various other data, such as tone color data. Operating members 104 include a keyboard, mouse, etc. in the case where the tone generation apparatus is implemented by a general-purpose PC, or includes various switches etc. provided on an external panel in the case where the tone generation apparatus is constructed as an electronic musical instrument. A display device 105 is provided for displaying various information, and a MIDI I/O 106 is connected with various MIDI devices for inputting and outputting MIDI signals from and to the MIDI devices.

A NAND-type flash memory 107 is a rewritable non-volatile memory having stored therein a plurality of sets of waveform data (i.e., sets of waveform sample data or waveform samples), where the waveform data are read and written on a page-by-page basis (in this case, each page comprises 2,048 bytes). The page-by-page data readout can be executed at a high speed by burst transfers. A memory map of the NAND-type flash memory 107 will be detailed later with reference to FIG. 2. A DP RAM 109 is a waveform data transferring buffer memory for transferring waveform data from the NAND-type flash memory 107 to a waveform memory 111, and it is in the form of a dual (two)-port semiconductor memory capable of simultaneously reading and writing data from and to the memory. Specifically, the DP RAM 109 is in the form of a static RAM (SRAM) and has a capacity capable of storing one page (2,048 bytes) plus error correction code. The waveform memory 111 includes a pre-load region for prestoring therein waveform sample data of respective leading or first pages (clusters) of the waveform data, and a buffer region for storing waveform sample data of two pages per tone generating channel. The waveform memory 111 is in the form of a synchronous dynamic RAM (SDRAM), and a memory map of the waveform memory 111 will be detailed later with reference to FIG. 3. The DP RAM 109 and the waveform memory 111 each allow random access thereto (i.e., data read or write responsive to a separately designated address) to be performed at an extremely high speed, but also permit access to successive addresses thereof at a high speed using a burst mode.

An F-to-DP transfer section 108 performs a process for transferring waveform data from the NAND-type flash memory 107 to the DP RAM 109 on a page-by-page basis. A DP-to-M transfer section 110 performs a process for transferring waveform sample data from the DP RAM 109 to the waveform memory 111 in such a manner that waveform sample data of each page is transferred dividedly in a plurality of blocks. These transfer sections 108 and 110 operate under control of a transfer control section 112. Waveform sample data transfer timing will be detailed later with reference to FIG. 4 etc. A transfer control section 112 controls the transfer from the NAND-type flash memory 107 to the DP RAM 109 and the transfer from the DP RAM 109 to the waveform memory 111. When a plurality of transfer requests have been made at a time, the transfer control section 112 performs control such that the waveform sample data are transferred page by page in order of priorities because only one page can be transferred at a time in the instant embodiment. Note that a data width of NAND-type flash memories available today is limited to eight bits, and thus, thus, the F-to-DP transfer section 108 connects two data, read out from two successive addresses of the NAND-type flash memory 107, into 16-bit data and writes the 16-bit data into the RAM 109 whose operating data width is sixteen bits. A data width of the waveform memory 111 too is sixteen bits, so that 16-bit data is stored into each address of the waveform memory 111. Therefore, the DP-to-M transfer section 110 need not perform data conversion as performed by the F-to-DP transfer section 108.

A tone generator 113, which includes a plurality of (128 (one-hundred and twenty-eight) in the illustrated example) tone generating channels (also referred to as "channel"), and, for each of the tone generating channels, generates a read address to read out waveform data (waveform sample data) from the waveform memory 11. Further, the tone generator 113 imparts an envelope to the read-out waveform sample data and thereby generates a tone signal for each of the tone generating channel. Further, the tone generator 113 mixes together the generated tone signals and imparts an effect, such as reverberation, to the mixed tone signal. The tone signal output from the tone generator 113 is converted into an analog audio signal via a DAC (Digital-to-Analog Converter) 114 and then audibly reproduced or sounded through a sound system 115.

Figure 2:
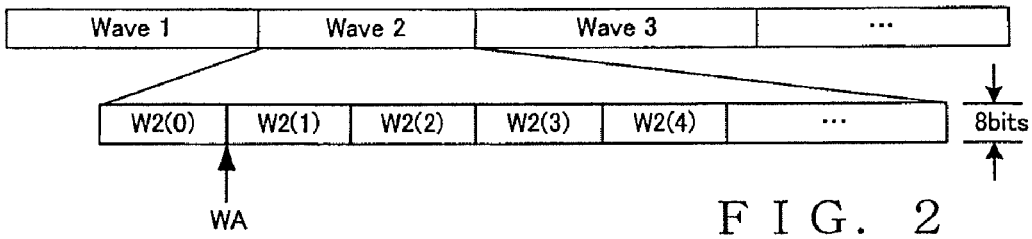
FIG. 2 is a diagram showing a memory map of a NAND-type flash memory employed in the embodiment.

FIG. 2 is a diagram showing the memory map of the NAND-type flash memory 107. The NAND-type flash memory has the characteristics that it is less costly than a mask ROM and can achieve a high data transfer speed (burst transfer) once the data readout of a page therefrom is started although it would take time to make immediate access to (or cue up) the page; the term "immediate access" is used herein to refer to a time section from a time point when a read command and read address are given to the flash memory to a time point when data readout from the flash memory is started, or a process performed in the time section. A plurality of waveform data Wave1, Wave2, . . . are prestored in the NAND-type flash memory 107. Each of the waveform data, e.g. Wave2, are stored in a plurality of pages W2(0), W2(1), . . . having successive addresses. Note that a plurality of successive pages of each of the waveform data Wave*(*=1, 2, . . . ) or waveform sample data stored in the pages are indicated by W*(0), W*(1), . . . . As noted above, each of the pages comprises 2,048 bytes (=1,024 words=1,024 samples). Because each waveform is stored in a plurality of successive pages in the NAND-type flash memory 107, which page should be read out need not be designated per page; page designation need be made only once per channel. Note that only the respective leading or first pages (W*(0)) of the waveform data Wave1, Wave2, . . . may be stored together in a separate region of the memory 107, in which case too the second page and succeeding pages of each of the waveform data Wave1, Wave2, . . . have to be stored successively. In the figure, "WA" indicates one of control registers, which sets an address of the second page W*(1) of the waveform data, details of which will be described later. Let it be assumed that the NAND-type flash memory 107 reads and writes data using an 8-bit data width.

Figure 3:
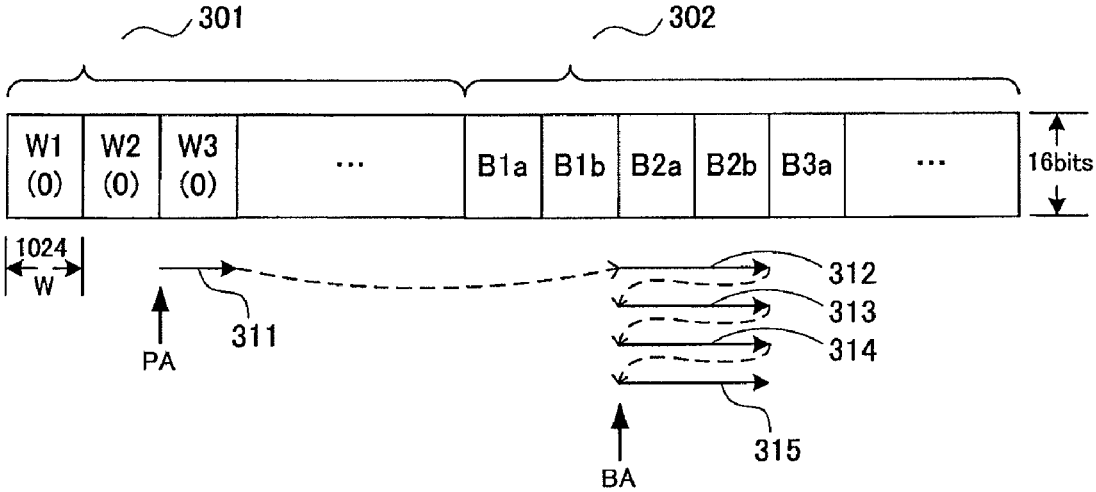
FIG. 3 is a diagram showing a memory map of a waveform memory employed in the embodiment.

FIG. 3 is a diagram showing the memory map of the waveform memory 111. The waveform memory 111 includes a pre-load region 301 and a buffer region 302. The preload region 301 is a region for storing the respective first pages W1(0), W2(1), W3(0), . . . of the waveform data Wave1, Wave2, Wave3, . . . stored in the NAND-type flash memory 107. The first pages W1(0), W2(1), W3(0), . . . are stored into the pre-load region 301 at the time of start-up of the system. The buffer region 302 includes two buffers for each of the tone generating channels; each of the buffers has a size of one page=2,048 bytes. pairs of the buffers corresponding to the tone generating channels (chi where i=1, 2, . . . , 128) are indicated by Bia and Bib. These buffers Bia and Bib are located successively in an address space of the waveform memory 111.

"PA" indicates one of control registers, which sets a read address, in the pre-load region 301, of the first page to be read out first when the tone generator 113 should read out waveform samples from the waveform memory 111. FIG. 3 shows a case where reproduction of the waveform data in the second tone generating channel has been instructed, and where the first page W3(0) is designated by the register "PA". An arrow 311 indicates an incrementing or progressing direction of read addresses (pitch counter) to be used when the tone generator section reads out the waveform samples of the first page. "BA" indicates one of control registers, which sets a read address indicating from which of the buffers of the buffer region 32 waveform samples should be read out after completion of the readout of the first page from the pre-load region 301. In the illustrated example of FIG. 3, where reproduction in the second tone generating channel has been instructed, leading addresses of the buffers B2a and B2b to be used by the second generating channel are set in the register BA as initial values at a time point when readout of the page W3(0) has been completed. An arrow 312 indicates an incrementing direction of read addresses (pitch counter). After the buffers B2a and B2b have been read, data readout goes back to the head of the buffer B2a to continue the readout as indicated by arrows 313 and 314. To realize such waveform memory readout, waveform sample data to be read out next are stored into the buffer B2a while readout of the pre-load region W3(0) is being performed, then waveform sample data to be read out next are stored into the buffer B2a while readout of the buffer B2a is being performed, then waveform sample data to be read out next are stored into the buffer B2b while readout of the buffer B2b is being performed, and so on. Namely, reproduction of the waveform sample data continue by the buffers B2a and B2b being used alternately. Note that three or more such buffers may be provided for each of the tone generating channels and the waveform memory 111 may read and write data using a 16-bit data width.

Figure 4A:
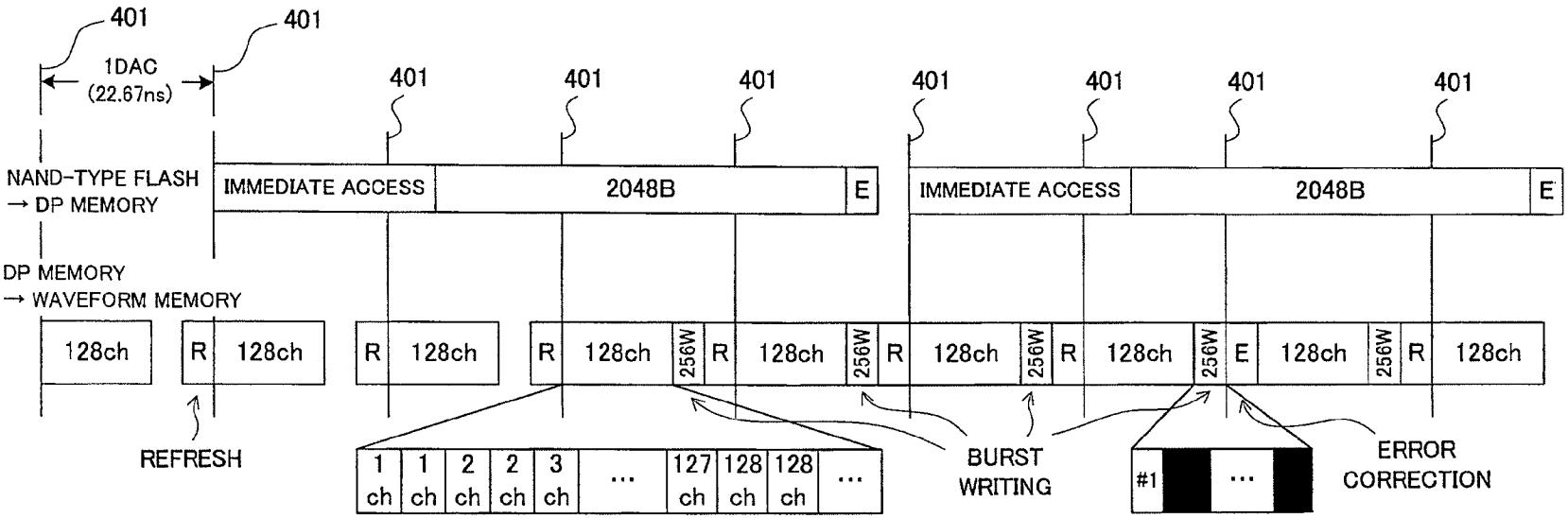
FIGS. 4A and 4B are timing charts explanatory of timing of waveform data transfer performed in the embodiment.

FIG. 4A is a timing chart explanatory of timing of waveform data transfer performed by the transfer sections 108 and 110 under control of the transfer control section 112, where the time passes in a direction of an arrow t. A plurality of vertical lines 401 indicate generation timing of sampling clock pulses, and intervals between the vertical lines 401 each represent one sampling period (hereinafter also referred to as "DAC" or "DAC period"). In the instant embodiment, one DAC period is 22.67 nsec. A time chart labeled "NAND-type Flash→DP memory" is a time chart of a process performed by the F-to-DP transfer section 108 for transferring waveform samples and error correction code of one page from the NAND-type flash memory 107 to the DP RAM 109, and a time chart labeled "DP Memory→Waveform Memory" is a time chart of a process performed by the DP-to-M transfer 110 for transferring waveform samples of one page from the DP RAM 109 to the buffer region of the waveform memory 111 (i.e., one of the buffers which corresponds to a designated channel) and a process performed by the tone generator 113 for reading out waveform samples from the waveform memory 111.

Reference numeral 411 in FIG. 4A indicates a time period in which immediate access is made to the page of the waveform data stored in the NAND-type flash memory 107. Following the end of the immediate access 411, 2,048-byte data of one page are read out (burst transferred). Reference numeral 413 indicates a time period for readout of error correction code. In the instant embodiment, data and error correction code of one page can be read out from the NAND-type flash memory 107 and written into the. DP RAM 109 within four DAC periods (sampling periods), as indicated by 411-413. The transfer time of four DAC periods is determined on the basis of specifications pertaining to page readout (burst transfer) of the NAND-type flash memory 107.

Reference numeral 421 in FIG. 4A indicates a time period in which the tone generator 113 reads out waveform samples of 128 channels from the waveform memory 111. Further, 422 indicates a time period in which waveform samples of one page in the DP RAM 109 are transferred to a buffer of a corresponding channel of the waveform memory 111. This transfer is one between the DP RAM 109 and the waveform memory 111 effected by high-speed data transfer in a burst mode. 423 indicates a time period for refreshing the waveform memory 111. A time length of the refreshing time period 423 is determined by specifications of the waveform memory 111. A portion of one DAC period other than the refreshing time period 423 (i.e., portion of one DAC period having the refreshing time period 423 excluded therefrom) is shared between the waveform sample readout time period 421 and the burst transfer time period 422.

A time length of the waveform sample readout time period 421 is determined by a designer of the instant system on the basis of required specifications as to in how many channels tone generation should be performed in the apparatus and between how many points interpolation should be performed in each of the channels, and specifications as to with what degree of time resolution and how many samples can be read out within one DAC period when the tone generator 113 reads out waveform samples of individual channels on a time-divisional basis. A time length of the burst transfer time period 421 is determined by the designer of the system on the basis of required specifications as to how many samples need be transferred within this time period, and speed (or rate) specifications pertaining to the burst transfer from the DP RAM 109 to the waveform memory 111. However, because the DP RAM 109 is a memory capable of reading and writing data simultaneously and having a size corresponding to one page plus error correction code, waveform sample data of one page having been read out from the flash memory 107 to the DP RAM 109 need be transferred from the DP RAM 109 to the waveform memory 111 within the same number of DAC periods as the number of DAC periods required for the transfer of one page from the flash memory 107 to the DP RAM 109. Thus, in one burst transfer time period 422, it is necessary to transfer a predetermined number of waveform samples calculated by dividing the number of waveform samples of one page by the above-mentioned number of DAC periods (a fraction after the decimal point is rounded up). In the instant embodiment, because it takes four DAC periods to read out 2,048-data (=1,024 samples) of one page from the flash memory 107 to the DP RAM 109, the transfer of the waveform sample data, having been read out to the DP RAM 109, to the waveform memory 111 is also performed dividedly in four DAC periods. Thus, in one burst transfer time period 422, 256 waveform samples, which is one quarter of 2,048 bytes (=1,024 samples) of one page, are transferred to the waveform memory 111.

The instant embodiment is based on the assumption that interpolations between two points are performed in each of the channels so that tone generation is performed in a total of 128 channels, and it is assumed that the waveform sample readout time period 421 has a time length necessary for permitting such a tone generation process. Further, let it be assumed that the instant embodiment employs hardware capable of performing a burst transfer of 256 samples (=512 bytes) in the burst transfer time period 422 that is a time section, other than the waveform sample readout time period 421 and refreshing time period 423, of one DAC period. After waveform sample data of one page have been transferred from the DP RAM 109 to the waveform memory 111 in four DAC periods, error correction is performed on the waveform samples of one page (2,048 bytes), having been transferred to the buffer region of the waveform memory 111 by that time, on the basis of the error correction code stored in the DP RAM 109. With the NAND-type flash memory, such error correction is not required.

Figure 9:
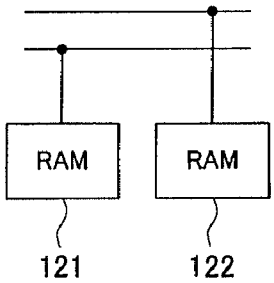
FIG. 9 is a diagram showing a structure comprising two separate RAMs in place of a dual-port RAM.

The "DP memory to→waveform memory" burst transfer is started in a DAC period two DAC periods later than the time point when the "NAND-type Flash→DP memory" was started. The reason why the "DP memory to→waveform memory" burst transfer is started in a DAC period two DACs later than the time point when the "NAND-type Flash→DP memory" was started is to allow one-page data of 2,048 bytes (=1,024 samples) (indicated at 412 in FIG. 4A) to be transferred dividedly by four burst transfers (indicated at 422), 256 waveform samples per each of the burst transfers (so that the 256 waveform samples to be transferred by each of the burst transfers have already been transferred from the NAND-type flash memory to the DP RAM 109 by the time when the burst transfer is to be started). Note that the DP RAM 109 need not necessarily be of a dual-port type RAM and may comprise two separate RAMs 121 and 122 as shown in FIG. 9. However, in the illustrated example of FIG. 1, the dual-port type DP RAM 109 is employed with a view to performing data writing and reading in a safe and reliable manner.

Figure 5:
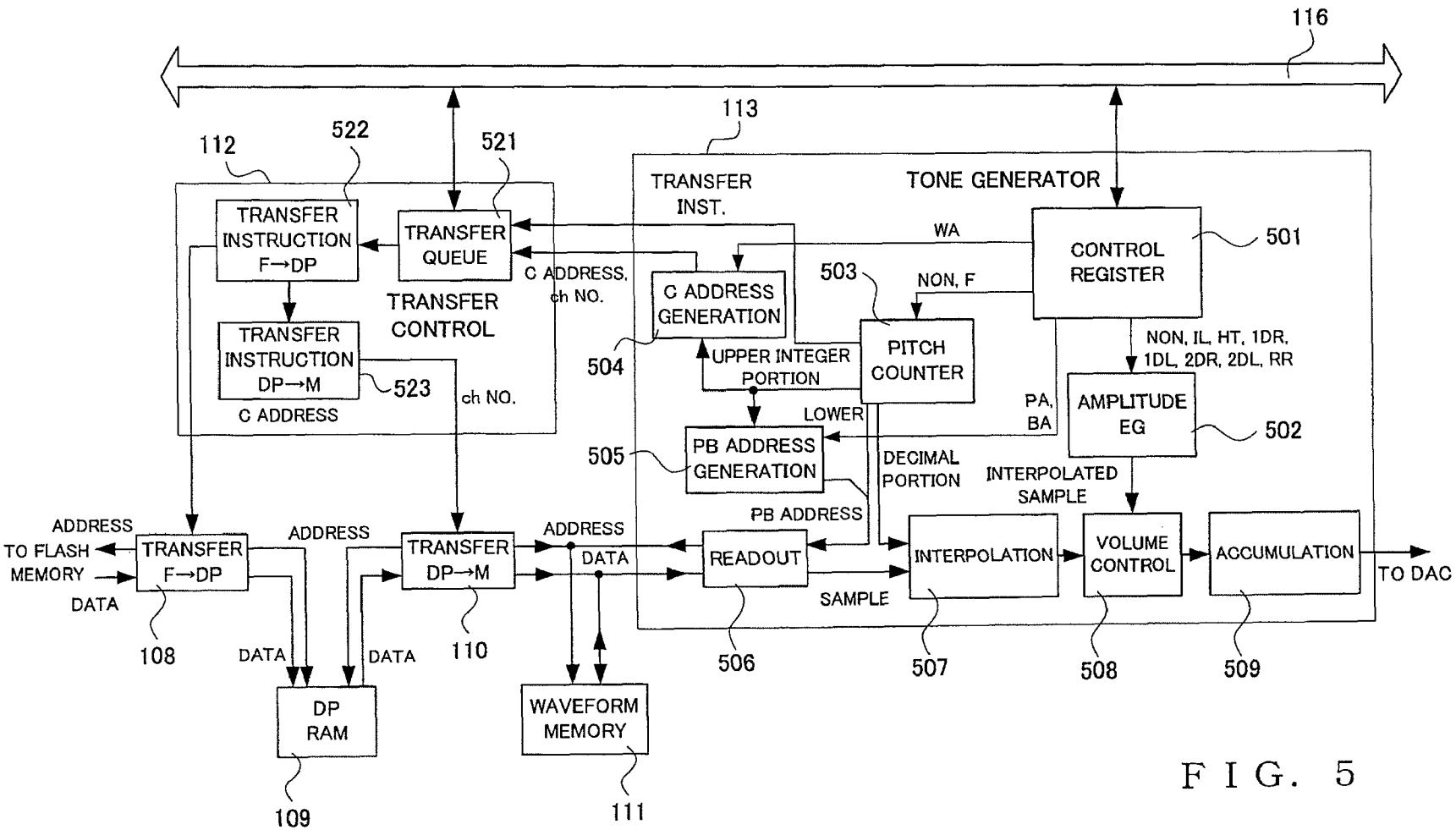
FIG. 5 is a block diagram showing details of a tone generator and a transfer control section.

FIG. 5 is a block diagram showing details of the tone generator 113 and transfer control section 112. The tone generator 113 includes control registers (tone generator registers) 501 for storing parameters and note-ON parameters NON of the channels. When a tone generation instruction has been given, for example, via the MIDI I/O 106, the CPU 101 assigns one of the channels to the tone generation (i.e., one of the channels that should generate a tone corresponding to the tone generation instruction), and sets and writes parameters based on performance information, corresponding to the tone generation instruction, into the control register corresponding to the assigned channel. Thus, the tone generator 113 starts a tone generation process in the assigned channel. Details of various registers will be discussed below.

(1) WA: This register is for setting therein an address of the second page W*(1) of the waveform data Wave* to be read out for the assigned channel from the NAND-type flash memory 107 shown and described in FIG. 2.

(2)PA: This register is for setting therein the first page W*(0) of the waveform data Wave* to be read out for the assigned channel from the pre-load region 301 of the waveform memory 111 described above in relation to FIG. 3. Note that, at the time of the star-up of the system, the respective first pages W1(0), W2(0), . . . of all of the waveform data Wave1, Wave2, . . . have already been stored (loaded) in the pre-load region 301.

(3) BA: This register is for setting therein respective addresses of the dual (double) buffers Bna and Bnb, corresponding to the assigned channel 302, in the buffer region 302 of the waveform memory 111 described above in relation to FIG. 3.

(4) F: This register is for setting therein an F number that is a parameter for shifting the pitch of the waveform data to be read out. A value of the F number is determined in accordance with a pitch of a tone to be generated. Namely, the F number is set at a value "1" when no pitch shift from the pitch of the waveform data is to be made, at a value greater than "1" when an upward pitch shift from the pitch of the waveform data is to be made, and at a value smaller than "1" when a downward pitch shift from the pitch of the waveform data is to be made.

(5) IL, HT, 1DR, 2DR, 2DL and RR: These registers are for setting therein parameters for controlling an envelope of the tone. IL indicates an initial level, and HT indicates a hold time. These parameters instruct that the initial value IL should continue to be fixedly output throughout the hold time HT following the start of tone generation. The waveform data prestored in the NAND-type flash memory 107 are each waveform data that appears to allow a real tone to be achieved if tone volume variation in an original waveform is used as-is for a rising portion of the tone. For this reason, the initial value IL is output as envelope waveform data throughout the time section of the hold time HT corresponding to the rising portion of the tone. 1DR indicates a first decay rate, and 1DL indicates a first decay level. These are parameters for outputting an envelope waveform that, following the hold time HT, leads to a first target value indicated by the first decay level 1DL at a variation rate indicated by the first decay rate 1DR. Similarly to above, 2DR indicates a second decay rate, and 2DL indicates a second decay level. These are parameters for outputting an envelope waveform that, following the first decay, leads to a second target value indicated by the second decay level 2DL at a variation rate indicated by the second decay rate 2DR. Once note-off timing arrives after the second decay, the tone volume level is gradually decreased at a variation rate indicated by the release rate RR. Once the tone volume level decreases to a predetermined level or below, the tone is deadened (silenced).

(6) NON: This register is for setting therein a note-on parameter instructing the start of tone generation.

Once the CPU 101 sets the above-mentioned parameters, including the note-on parameter, into the control register 501 corresponding to the assigned channel, the tone generator 113 starts a tone generation process in the channel. Note that various parameters shown in the block of the tone generator 113 of FIG. 5 indicate parameters being processed in the channel. Namely, as the assigned processing channel changes to another, values of the parameters change.

The following describe processing performed for one of the channels in various blocks. Similar processing is performed for all of the 128 channels on the time-divisional basis so that a plurality of tones are generated concurrently in a parallel fashion.

Note-on parameter and F number are input to the pitch counter 503. The pitch counter 503 is reset to zero at the note-on timing and then accumulates the F number every DAC period. The accumulated value is output as an integer portion address and a decimal portion address. Although the pitch counter 503 continues accumulating the F number even after note-off of the tone, it stops accumulating the F number once the tone generation processing for the channel is brought to an end, Lower ten bits of the integer portion of the accumulated value output from the pitch counter 503 are supplied to a readout section 506.

A PB address generation section 505 receives the PA (i.e., address of the first page in the pre-load region 301 of the waveform memory 111 (see FIG. 3)) and BA (addresses of the buffers Bna and Bnb, corresponding to the channel, in the waveform memory 111) discussed at (2) and (3) above, and then outputs a PB address to the readout section 506. The PB address is an upper address for designating a leading portion of a to-be-read-out region of the waveform memory 111; actually, however, because the PB address comprises only an upper portion, an address with ten bits of "0s" added to the lower end of the PB address is set as an absolute address for designating the leading location of the to-be-read-out region of the waveform memory 111. More specifically, the PB address generation section 505 outputs the PA address as the PB address at a stage immediately following the start of the tone generation; then outputs the BA address as the PB address upon completion of readout of the waveform sample data of the first page stored in the pre-load regions 301 of the waveform memory 111 and designated by the PA address; then outputs (BA+1) as the PB address upon completion of readout of the waveform sample data of the buffer B*a provided in the buffer region 302 of the waveform memory 111 and corresponding to the channel (because the BA address comprises only an upper portion without lower ten bits as noted above, (BA+1) indicates the buffer B*b); then outputs again the BA address as the PB address upon completion of readout of the waveform data stored in the buffer B*b provided in the buffer region 302 of the waveform memory 111 designated by (BA+1) and corresponding to the channel; and thereafter outputs alternately BA and (BA+1) as the PB address in such a manner that the waveform sample data stored in the buffer B*a and stored in the buffer B*b are read out alternately. As noted above, a read address (absolute address) is generated by adding, to the lower end of the PB address, lower ten bits of the integer portion output from the pitch counter 503. The readout section 506 reads out, from the waveform memory 111, the waveform sample data of the channel in question using the thus-generated read address. Let it be assumed that the readout section 506 reads out two waveform samples, i.e. waveform sample of the read address and next waveform sample. Note that each address of the waveform memory 111 has a length corresponding to a length of a word.

An interpolation section 507 performs, every DAC period, two-point (linear) interpolation between the read-out two samples in accordance with a decimal portion address (output from the pitch counter 503), to thereby calculates one interpolated sample. The interpolation section 507 outputs an interpolated sample "0" for each channel of where the tone generation process has been terminated.

An amplitude envelope generator (EG) 502 generates an amplitude envelope (AE) waveform on the basis of an envelope waveform generating parameter of the channel in question, and then it outputs the thus-generated amplitude envelope to a tone volume control section 508. Every DAC period, the tone volume control section 508 controls an amplitude of the interpolated sample on the basis of a value of the amplitude envelope (AE) waveform and outputs the amplitude-controlled interpolated sample as a tone sample of the channel in question. Every DAC period, an accumulation section 509 accumulates tone samples of all of the channels and outputs the accumulated result as a tone sample of all of the channels. Note that the tone sample may be output with a reverberation and other effect imparted thereto via a not-shown effect imparting section.

The upper bits of the integer portion (from which the lower ten bits of the integer portion have been removed) output from the pitch counter 503 are input to a C address generation section 504 and the PB address generation section 505. To the C address generation section 504 is also input an address WA of a second page in the NAND-type flash memory 107 (see FIG. 2). The C address generation section 504 generates and outputs a C address on the basis of the input data. The C address is a cluster (page) address specifying a to-be-read page of the waveform data in the NAND-type flash memory 107. How the C address varies will be detailed later with reference to FIG. 6.

The C address generated for the channel in question is input, together with the channel number of the channel, to a transfer queue (register) 521 provided within the transfer control section 112. The transfer queue (register) 521 is a first-in-first-out (FIFO) queue. Once a transfer instruction is output from the pitch counter 503, the transfer queue 521 takes in and registers the C address and channel number into the transfer queue, timing of which will be described later with reference to FIG. 6. It means that page data of the C address should have been transferred from the NAND-type flash memory 107 to the waveform memory 111 via the DP RAM 109 before completion of readout of page data (i.e., waveform sample data of a page) that is being read out and reproduced for the channel.

When no page data is being transferred from the NAND-type flash memory 107 to the DP RAM 109, an F-to-DP transfer instruction section 522 takes out the C address and channel number from the transfer queue 521 and instructs the F-to-DP transfer section 108 to transfer the page data, stored in the NAND-type flash memory 107 and specified by the C address, to the DP RAM 109. In response to the instruction from An F-to-DP transfer instruction section 522, the F-to-DP transfer section 108 transfers the one-page data (411-413 in FIG. 4A) as explained above in relation to the flow chart labeled "NAND-type Flash→DP memory". More specifically, once the F-to-DP transfer section 108 outputs, to the NAND-type flash memory 107, a readout instruction specifying the C address, one-page data is burst transferred from the NAND-type flash memory 107, so that the burst transferred data are written into the DP RAM 109.

Further, when the F-to-DP transfer instruction section 522 outputs the transfer instruction to the F-to-DP transfer section 108, it also transmits the transfer instruction and channel number to a DP-to-M transfer instruction section 523. In response to the transfer instruction, the DP-to-M transfer instruction section 523 outputs the channel number and transfer instruction to the DP-to-M transfer 110 to control the DP-to-M transfer 110 to burst transfer the page data of the DP RAM 109 to the buffer of the waveform memory 111 corresponding to the channel. In this manner, a burst transfer (422 in FIG. 4A) from the DP-to-M transfer 110 to the buffer region of the waveform memory 111 is performed as explained in the time chart "DP memory→Waveform Memory". More specifically, upon receipt of the channel number and transfer instruction from the DP-to-M transfer instruction section 523, the DP-to-M transfer 110 outputs a read instruction, designating the address of the page data, to the DP RAM 109 within one DAC period two DAC periods after the transfer instruction and following an access period (421 in FIG. 4A) when the tone generator 113 accesses the waveform memory 111. Thus, leading 256 words of the page data are burst transferred from the DP RAM 110 to the buffer region, so that the burst transferred data are written into the buffer of the channel as shown at 422 of FIG. 4. Similarly, the succeeding data of (256 words×three blocks) are burst transferred and written into the buffer of the channel in the waveform memory 111 using the succeeding three DAC periods.

Note that, when 256 words are to be transferred to the buffer of the channel in the waveform memory 111 through the "DP memory→waveform memory" burst transfer, it is necessary to determine in advance to which of the two buffers B*a and B*b the 256 words should be transferred. At that time point, the tone generator 113 in the instant embodiment should already being reading out waveform samples from any one of the pre-load region 301 and buffers B*a and B*b of the waveform memory 111 for that channel, and thus, the instant embodiment sets the buffer B*b as the burst transfer destination if waveform samples are being read out from the pre-load region 301 or buffer B*a, or sets the buffer B*a as the burst transfer destination if waveform samples are being read out from the buffer B*b.

Figure 6:
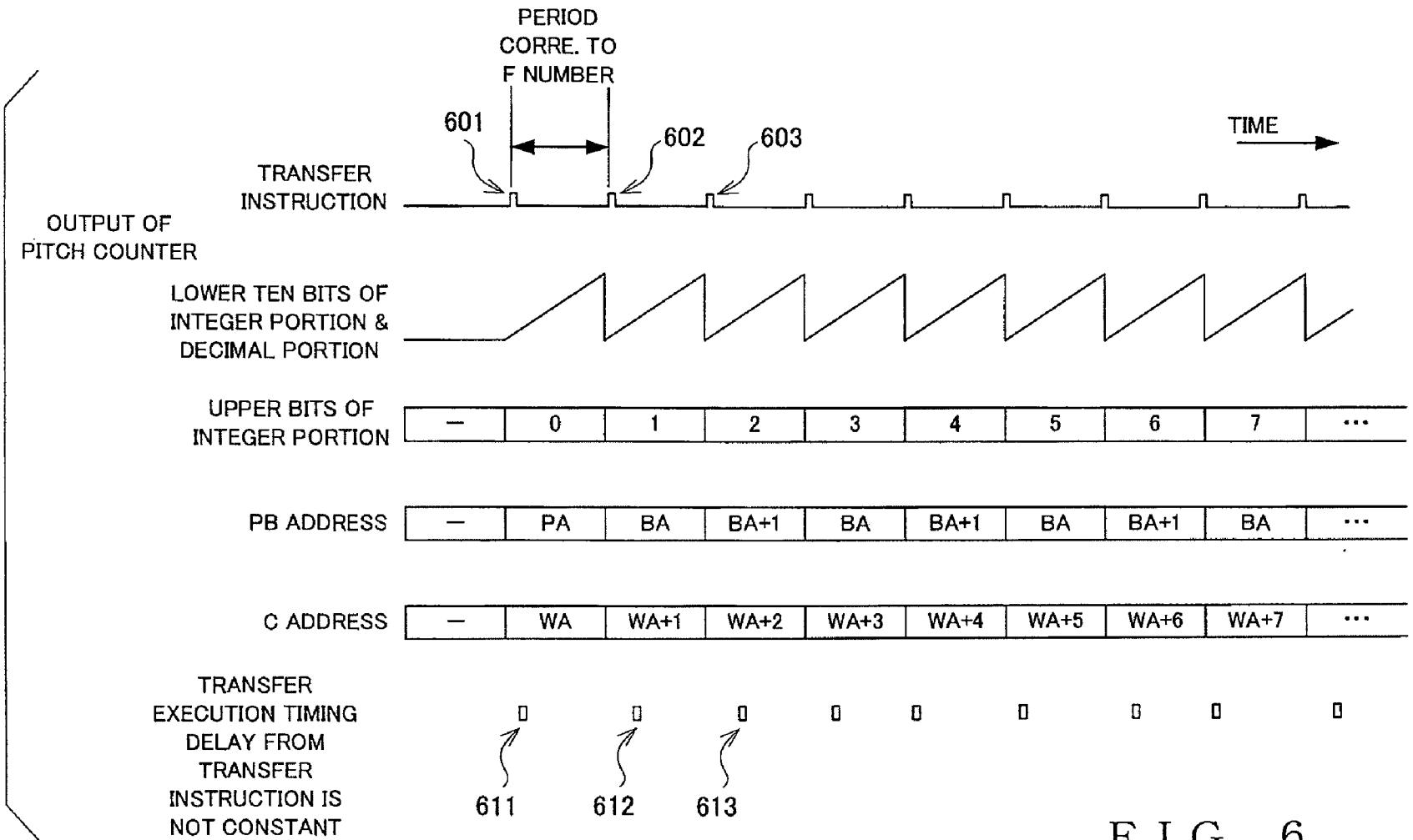
FIG. 6 is a diagram showing variation over time of various addresses following the start of tone generation.

FIG. 6 is a diagram showing variation over time of various addresses (for one channel) following the start of tone generation. In the figure, "Lower Ten Bits of Integer Portion & Decimal Portion" indicates variation over time of lower ten bits of an integer portion and decimal portion of an accumulation result (accumulated value) obtained by the pitch counter 503 accumulating the F number. The lower ten bits of the integer portion and decimal portion increase in value as the accumulation of the F number progresses. Once the lower ten bits of the integer portion exceeds a value "1,023", a carry occurs, so that the value returns to "0" (to be more exact, the value is "1" or less because a value of the decimal portion is still left). In this manner, the accumulated value presents variation of a sawtooth shape as shown in the figure. "Upper Bits of Integer Portion" indicates variation over time of an upper portion of the count value of the pitch counter 503 (i.e., upper portion of the accumulation result with the lower ten bits of the integer portion and the decimal portion excluded therefrom). The upper bits of the integer portion has a value "0" immediately after the start of tone generation and then increases by one each time a carry occurs in the lower ten bits of the integer portion and decimal portion.

"Transfer Instruction" in FIG. 6 indicates a transfer instruction signal output from the pitch counter 503 of FIG. 5 to the transfer queue 521. The transfer instruction is output at the time of the start of tone generation as indicated at 601 and then output each time a carry occurs in the lower ten bits of the integer portion and decimal portion as indicated at 602 or 603. Further, "PB Address" shows variation over time of the PB address output from the PB address generation section 505 of FIG. 5. A PA address (i.e., address of the first page in the pre-load region 301 of the waveform memory 111 (see FIG. 3)) is output as the PB address immediately after the start of tone generation, and after that, one of a BA address (i.e., address of the buffer B*a corresponding to the channel) and a "BA+1" address (i.e., address of the buffer B*b corresponding to the channel) is output in an alternate fashion each time the upper bits of the integer portion are counted up.

"C Address" in FIG. 6 shows variation over time of a C address which the C address generation section 504 outputs to the transfer queue 521. Because the page that should have been read out to the waveform memory 111 immediately after the start of tone generation is the page designated by the second page address WA of the waveform data in question (see FIG. 2), the address WA is output as the C address, and after that, the address WA increments by one each time the upper bits of the integer portion are counted up. The C address is generated by adding a value of the upper bits of the integer portion to the address WA. Note that, because the WA address is made an absolute address by "0" of ten bits being added to the lower end of the address WA similarly to the PB address and the like, (WA+1) designates the third page W2(2), (WA+2) designates the fourth page W2(3), and so on.

Furthermore, "Transfer Execution Timing" in FIG. 6 shows timing at which the F-to-DP transfer instruction section 522 and the DP-to-M transfer instruction section 523 of FIG. 5 actually execute the transfers explained above in relation to FIG. 4. For example, even if the transfer instruction 601 has been output to the transfer cue 521 and the C address and channel number have been registered in the transfer cue 521, a transfer of another channel might sometimes being executed at that time point. Therefore, the transfer of FIG. 4 is not necessarily performed immediately, and it is performed at slightly delayed timing 611. Similarly, a transfer of a C address and the channel number registered into the transfer cue 521 in response to a transfer instruction 602 is executed at timing 612, a transfer of a C address and the channel number registered into the transfer cue 521 in response to a transfer instruction 603 is executed at timing 613, and so on; namely, each of these transfers is executed with a slight delay from the transfer instruction. Such a delay is not constant because it depends on a state of congestion of transfers being executed in the other channels. Needless to say, a transfer registered in response to one transfer instruction has to be executed prior to arrival of a next transfer instruction; for example, the transfer registered in the transfer cue 521 in response to the transfer instruction 601 has to be executed prior to arrival of the transfer instruction 602, the transfer registered in the transfer cue 521 in response to the transfer instruction 602 has to be executed prior to arrival of the transfer instruction 603, and so on.

The following describe a timing design pertaining to access to the NAND-type flash memory 107. In the instant embodiment, the sampling frequency is 44.1 kHz, and one DAC period is 22.67 nsec, as mentioned earlier. As described above in relation to FIG. 2, each waveform data (i.e., each set of waveform sample data) is stored successively in the flash memory 107 page by page, i.e., in units of pages (each page comprising 2,048 bytes or 1,024 waveform sample data). Assuming a case where one page of waveform sample data (i.e., 1,024 waveform samples) is transferred to the waveform memory 111 via the DP RAM 109 and these waveform samples are reproduced with no upward pitch shift (i.e., with the F number set at "1"), a reproduction time of the one page will be 1,024 DACs; such a reproduction time period will hereinafter referred as to "fundamental reproduction period". Readout of one page from the flash memory 107 (such readout will hereinafter be referred to as "unit access") takes four DACs, as explained above in relation to FIG. 4. Thus, the unit access can be performed 1,024/4 (=256) times during the fundamental reproduction period. Thus, if no pitch shift is made, the maximum number of reproducible channels will be 256.

Now consider a case where an upward pitch shift is made through one octave in all of the tone generating channels. In this case, the waveform samples are read out with the F number set at a value "2" in all of the tone generating channels, and thus, 1,024 every other (i.e., every second) waveform sample of one page transferred to the waveform memory 111 in response to one access is used in each DAC period, so that reproduction of the 1,024 waveform samples can be completed in 512 DACS that is half of the DACs in the fundamental reproduction period. Therefore, the unit access can be performed 512/4 (=128) times during the fundamental reproduction period. Thus, in the case where an upward pitch shift is made through one octave in all of the tone generating channels, the maximum number of reproducible channels is 128. This case corresponds to a later-described first example.

As seen from the foregoing, the number of the channels capable of generating tones and an upper limit of the F number (upper limit of an upward pitch shift) are in a tradeoff relationship. Thus, because the fundamental reproduction period is determined on the basis of the specifications of the flash memory 107 (particularly, size of a page and the number of DACs required for the unit access), the number of the channels capable of generating tones and the upper limit of the F number (when an upward pitch shift is to be made simultaneously in all of the channels) may be determined on the basis of such specifications of the flash memory 107. Namely, if the number of the channels capable of generating tones is already determined, the F number may be determined in correspondence with the number of the channels capable of generating tones. If, on the other hand, the upper limit of the F number is already determined, then the number of the channels capable of generating tones may be determined in correspondence with the upper limit of the F number. Note that, when a downward pitch shift is to be made, waveform sample data can be reproduced for more than the fundamental reproduction period with each page comprising 1,024 waveform samples, and the unit access can be performed an increased number of times than in the aforementioned case; thus, the relationship between the number of the channels capable of generating tones and the upper limit of the F number will have a little leeway.

The following describe a timing design pertaining to access to the waveform memory 111. In the instant embodiment, 1,024 samples transferred to the DP RAM 109 in response to one unit access are burst transferred to the waveform memory 111 dividedly in four DAC periods, 512 bytes per DAC period (see FIG. 4A). This is because one unit access (i.e., readout of one-page data from the flash memory 107) takes four DAC periods. A portion of one DAC period other than the burst transfer period and refreshing period of the waveform memory 111 is used as a time period in which the tone generator 113 reads out waveform samples for tone generation in each of the tone generating channels. Thus, in a case where a relatively great burst transfer period has to be secured, the waveform sample readout period for the individual tone generating channels has to be reduced, and thus, the number of the tone generating channels capable of generating tones has to be reduced accordingly. If, on the other hand, the burst transfer period and the number of the burst transfers can be reduced, the number of the tone generating channels capable of generating tones can be increased accordingly.

The following explain terms "band width" and "total band width" used herein. The term "total band width" is used herein to refer to a maximum number of pages that can be read out from the flash memory 107 in the abovementioned fundamental reproduction period (i.e., reproduction period in which waveform sample data of one page are reproduced at a rate of one sample per sampling period); in other words, the "total band width" means an upper limit of the number of times the transfer instruction can be issued in the fundamental reproduction period. For example, in a case where tone generation is performed in a given tone generating channel with the F number set at "1", and if the transfer instruction is issued only once in the fundamental reproduction period (1,024 DACs), then 1,024 samples written into the waveform memory 111 through the one transfer can realize waveform sample reproduction with the F number of "1" in the fundamental reproduction period; thus, the band width for the channel is "1". If the F number is "2", the band width for the channel is "2". Further, if the F number is "1.1", eleven transfer instructions (i.e., transfers of eleven pages) are required in ten fundamental reproduction periods, and thus, two extra transfer instructions must be issued somewhere in the ten fundamental reproduction periods, in which case the band width for the channel is "2". Thus, a value obtained by rounding up a decimal portion of the F number becomes the band width of that channel. Further, there is a need for preventing a sum of the band widths of all of the tone generating channels from exceeding the total band width.

Now, a description will be given about three examples employed in the embodiment of the system corresponding to various conditions of the timing design.

Figure 7A:
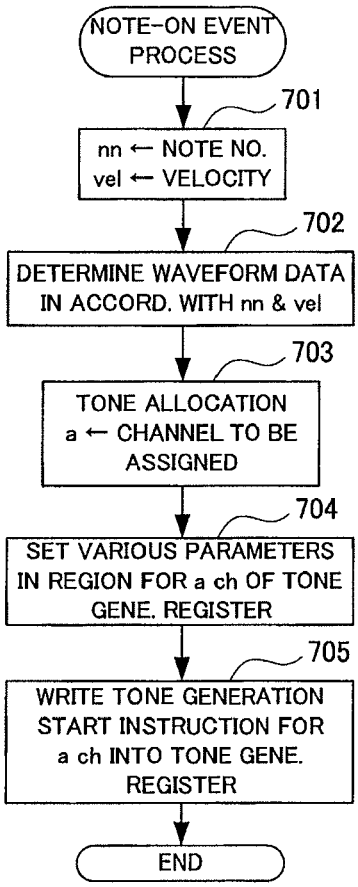
FIGS. 7A to 7C are flow charts of a note-on event process and a tone generation allocation process.

FIG. 7A is a flow chart of a note-on event process that is applied to any of the first to third examples. The note-on event process is started up, for example, in response to receipt of a MIDI note-on event from the MIDI I/O 106. At step 701, a note number and velocity are set into registers nn and vel on the basis of performance information of the received (or input) MIDI note-on event. At next step 702, one waveform data corresponding to the note number nn and velocity vel is determined (or selected) from among a plurality of waveform data stored in the flash memory 107 and corresponding to a currently selected tone color. In the NOR-type flash memory 103 of FIG. 1 are prestored tone color data of various tone colors, and each of the tone color data includes waveform selection information for permitting selection of waveform data corresponding to a tone color data nn and velocity vel. At step 703, one of the tone generating channels is assigned, and the channel number of the assigned tone generating channel is set into a register a. At following step 704, various parameters are set into regions for the channel (a ch) of the control register 501 in the tone generator 113. An F number for controlling a pitch shift can be determined on the basis of a difference between an original or unshifted pitch (cent) of the determined waveform data and a pitch (cent) indicated by the note number nn. The aforementioned parameters WA and PA and envelope-related parameters are contained in the tone color data. BA can be determined on the basis of the assigned channel number. Finally, at step 705, a tone generation instruction of the assigned channel number (a ch) is written into a note-on register NON, after which the note-on event process is brought to an end. This note-on event process is performed by hardware components provided in an area from the NAND-type flash memory 107 to the tone generator, without any interrupt being given to the CPU 101.

The following describe the first example. In the first example, the upper limit of the F number is limited to "2", and the number S of the tone generating channels is set at "128" that is an upper limit assuming a case where an upward pitch shift is made through one octave in all of the channels simultaneously. Here, the total band width T is "256", and the number S of the tone generating channels is set at "128" smaller than the total band width of "256".

As noted above, a plurality of waveform data recorded with different tone pitches are prestored in advance for each of various tone colors. At step 702 of FIG. 7A, one waveform data corresponding to a note number nn and velocity vel is selected from among the plurality of waveform data prestored in the number of the tone generating channels, in accordance with tone-color-specific waveform selection information. The waveform selection information is information that not only defines a plurality of non-overlapping pitch ranges (regions) and intensity ranges (regions) for all note numbers and velocities for which tones of the tone color in question should be generated but also allocates one of the waveform data, corresponding to the tone color, to each of the regions. At step 702, this waveform selection information is referenced in accordance with the note number nn and velocity vel, so that one region containing the note number nn and velocity vel is detected from among the plurality of regions, and one waveform data allocated to the detected region is selected. Namely, one waveform is selected in accordance with the note number nn. The recorded pitch of the waveform data selected here is not necessarily the same as the pitch indicated by the note number nn, and thus, at step 704 above, an F number is determined for pitch-shifting the selected waveform data to the pitch indicated by the note number nn.

In the first example, the waveform selection information is devised in such a manner that waveform data, of which the F number determined at step 704 above takes a value equal to or smaller than "2" is selected. More specifically, for each of a plurality of waveform data of a certain tone color, an upper limit of note numbers of regions to which the waveform data is allocated is made equal to or smaller than a note number corresponding to a pitch to which the waveform data is shifted upward through one octave.

By providing such waveform selection information in corresponding relation to various tone colors, the F number determined at step 704 in relation to the waveform data selected at step 702 in accordance with the note number nn can be made equal to or smaller than "2". Whereas the F number has been described above as limited to the upper limit of "2", the upper limit need not necessarily be "2" and may be "2.5" or less, or "3" or less. In short, it is only necessary that an integer portion of a quotient, calculated by the total band width T being divided by the number S of the channels (i.e., TIS), be equal to or smaller than the F number. Thus, it is only necessary to prepare in advance a plurality of waveform data per tone color, select one of the waveform data such that the F number can be equal to or smaller than the integer portion of the quotient TIS and determine the F number when determining, at steps S702 and 704 of FIG. 7A, waveform data and F number to be used for tone generation.

Figure 7B:
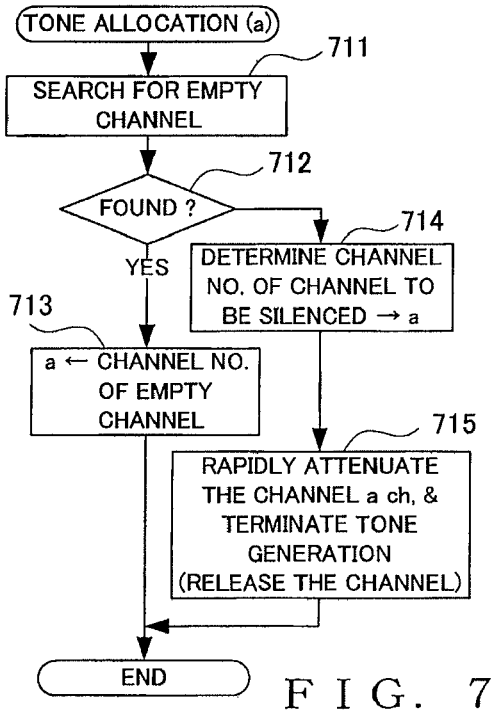

FIG. 7B shows a tone generation allocation process performed in the first example. In the first example, the tone generation allocation process of FIG. 7B is performed at step 703 of FIG. 7A. At step 711, a search is made for an empty channel. If any empty channel has been found, the channel number of the empty channel is set into the register a at step 714, after which the tone generation allocation process is brought to an end. If no empty channel has been found at step 712, the channel number of a channel where a generated tone is to be deadened is determined at step 714, and then the generated tone of the channel determined at step 714 is rapidly attenuated and deadened so that the channel is released at step 715, after which the tone generation allocation process is brought to an end.

The following describe the second example. In the second example, the upper limit of the F number is not limited, and the number of unit access (band width) for all of the channels in the fundamental reproduction period is limited to the total band width that is an upper limit. Namely, while an increased number of unit access in the fundamental reproduction period is required for each channel where an upward pitch shift has been made, the number of unit access can be reduced for each channel where a downward pitch shift has been made. Thus, in the second example, it is only necessary that the number of unit access (band width) for all of the channels in the fundamental reproduction period be limited to an upper limit of the number of times of unit access (i.e., total band width) as a whole.

Figure 7C:
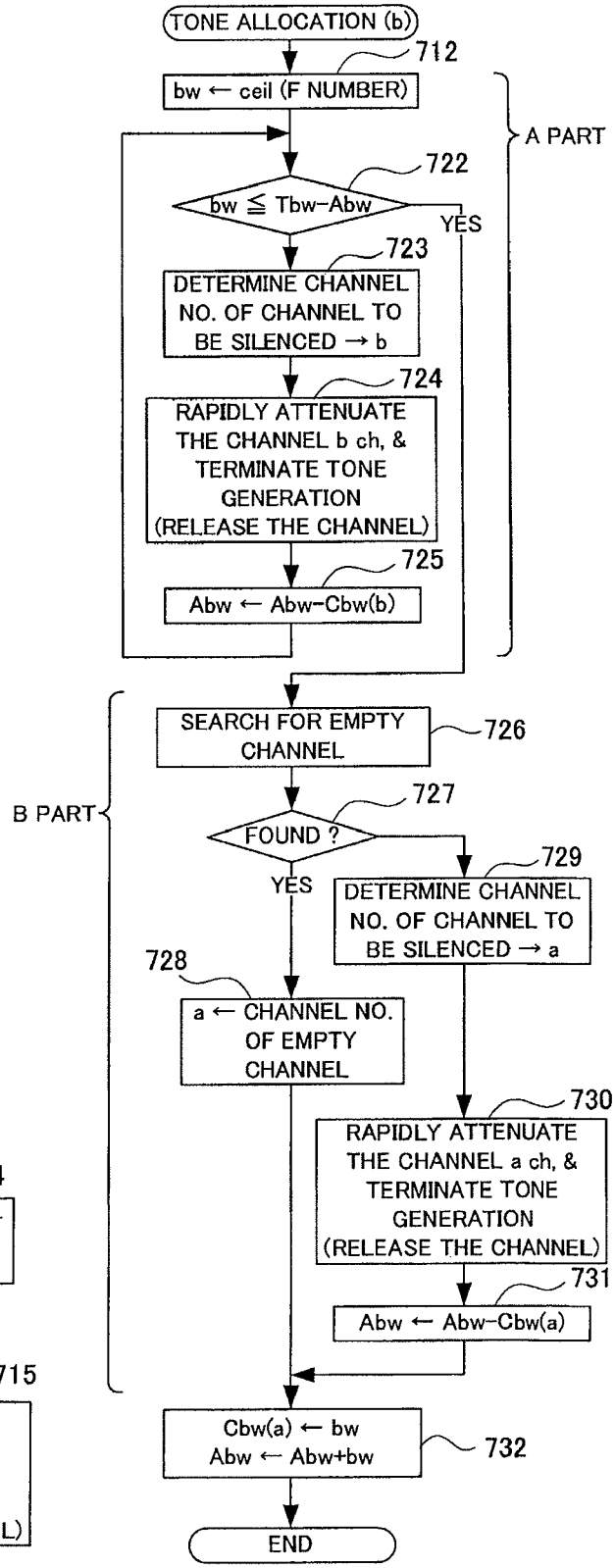

FIG. 7C shows a tone generation allocation process performed in a second example. In the second example, the tone generation allocation process of FIG. 7C is performed at step 703 of FIG. 7A. At step 721, an F number (ceil) is set into a register bw. "ceil(j)" is a function for rounding up a decimal portion of a numerical value j. Thus, a numerical value obtained by rounding up a decimal portion of an F number, i.e. band width of the channel in question is set into the register bw. On the other hand, the total band width of the tone generator 113, i.e. the upper limit of the number of times a transfer instruction can be issued within the fundamental reproduction period is of a constant value (in this embodiment, 1,024/4=256 because 4 DACs are required for one transfer), and this value is set as Tbw. Further, a currently-allocated total band width is set as Abw. At step 722, a comparison is made between the band width bw to be allocated to the channel in question and a value obtained by subtracting the currently-allocated total band width Abw from the total band width Tbw (i.e., empty band width). If the former is greater than the latter, it means that the band width bw of the channel ch cannot be allocated, and thus, the channel number of a channel where tone deadening is to be effected is determined and set into a register b at step S723. Then, at step 724, a generated tone of the channel (bch) is rapidly attenuated and deadened or silenced so that the channel is released. At nest step 725, Cbw(b) is subtracted from Abw, and control reverts to step 722. Cbw(i) indicates a band width allocated to the channel ich. Now that the channel (bch) has been silenced, the band width allocated to the channel (bch) is empty, and this empty channel is subtracted from the currently-allocated total band width Abw.

If bw≦Tbw−Abw at step 722, it means that there is a band width that is to be allocatable, so that control jumps to step 726, where a search is made for an empty channel. If any empty channel has been found at step 727, the channel number of the empty channel is set into the register a at step 728, and control proceeds to step 732. If no empty channel has been found at step 727, the channel number of a channel where a generated tone is to be deadened is determined as a "note-off channel" and set into the register a at step 729, and then the generated tone of the channel determined at step 729 is rapidly attenuated and deadened (silenced) so that the channel is released at step 730. Then, Cbw(b) is subtracted from Abw at step 731, and control proceeds to step 732, where the band width bw allocated to the channel (a ch) is set into Cbw(a) and the band width bw is added to the currently-allocated total band width Abw.

Once the tone of the channel (c ch) designated as a note-off channel attenuates to below a predetermined level, the tone generation of the channel (c ch) is terminated to release the channel, and band information updating, i.e. "Abw←Abw−Cbw" and "Cbw(c)←0", is performed. Whereas the process of FIG. 7C is shown as performing an "A Part" and then a "B Part", the "B Part" may be performed prior to the "A Part".

The following describe a third example. In the third example, an upper limit of the number of times of unit access and the number of the channels capable of generating tones are set at a same number to simplify the processing. Whereas the total band width Tbw of the tone generator 113 is "256" in the above-described embodiment of FIGS. 1-6, a total number of the tone generating channels is "256" in the third example; thus, "128" mentioned as the number of the tone generating channels in various portions of the above description about FIGS. 1-6 is replaced with "256" in the following third example. If all of the 256 channels are generating tones, it means that at least 256 band widths are being used. Conversely, if there is at least one unused band, it means that there is necessarily one or more empty channel. Thus, in the third example, operations corresponding to the B part in the second example are unnecessary.

Figure 4B:
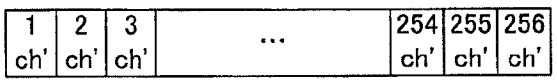

FIG. 4B is a diagram explanatory of a manner in which the tone generator 113 reads out, from the waveform memory 111, waveform samples of 256 channels in the time period 421 of FIG. 4A within one DAC period. Let it be assumed that, for each of the channels, a plurality N of waveform samples are read out in a burst mode (burst read out). Namely, in the illustrated example of FIG. 4B, N waveform samples of the first channel are read out in the burst mode in a time period for the first channel (1 ch'), N waveform samples of the second channel are read out in the burst mode in a time period for the second channel (2 ch'), and so on. How many are the N waveform samples depends on between how many points the interpolation is to be performed. If the interpolation is to be performed between two points (i.e., two-point interpolation), N=2, if the interpolation is to be performed between three points (i.e., three-point interpolation), N=3, and so on. Stated differently, there is a need to use hardware capable of reading out waveform samples of 256 channels in the time period 421 as shown in FIG. 4B.

Figure 8:
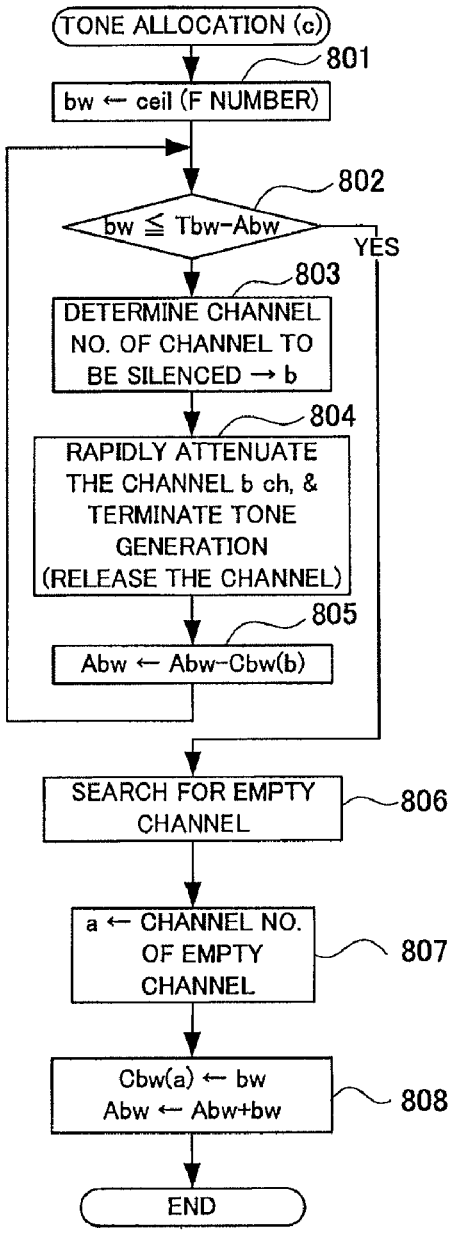
FIG. 8 is a flow chart shows another example of the tone generation allocation process.

FIG. 8 shows a tone generation allocation process performed in the third example. The tone generation allocation process of FIG. 8 is performed at step 703 of FIG. 7A. Operations of steps 801 to 805 are similar to the operations of steps 721 to 725 in the second example of FIG. 7C. A search is made for an empty channel at step 806; however, because, as noted above, there is necessarily an empty channel if there is a band width that is allocatable, an empty channel can be necessarily found. Operations of steps 807 and 808 are similar to the operations of steps 728 and 732 in the second example of FIG. 7C.

In each of the first to third examples, as shown and described in FIG. 4A, timing between the two transfers, i.e. the transfer from the flash memory 107 to the DP RAM 109 and the transfer from the DP RAM 109 to the waveform memory 111, is devised in such a manner that, prior to completion of the transfer of a page from the flash memory 107 to the DP RAM 109, the transfer from the DP RAM 109 to the waveform memory 111 can start with a portion of the waveform sample data of the page having already been transferred to the DP RAM 109. Further, the page transferred from the flash memory 107 to the DP RAM 109 in four DAC periods are transferred from the DP RAM 109 to the waveform memory 111 in four DAC periods with a delay of two DACs. In this way, the necessary capacity of the DP RAM 109, which is an intermediate buffer, can be reduced to as small as one page. Further, by performing the transfer from the DP RAM 109 to the waveform memory 111 in the burst mode, it is possible to increase the number of times of access to the waveform memory 111 made by the tone generator 113 and hence the number of channels capable of generating tones.

The various values mentioned above in each of the examples may be modified as necessary. Each of the pages in the flash memory 107 is not limited to the size of 2,048 bytes and may be of any other suitable size, such as 1,024 bytes or 4,096 bytes, depending on the specifications of the flash memory 107. Further, the number T of times of unit access in the fundamental reproduction period is not limited to 256 and may be any other suitable number, such as 300, 450 or 512, depending on the specifications of the flash memory 107. Further, the number of waveform sample data read out from the waveform memory 111 is not limited to 256 (two samples for each of 128 channels) and may be any other suitable number, such as 310, 460 or 512, depending on specifications as to with what degree of time resolution of slots each waveform data sample can be read out when the tone generator 113 reads out waveform samples from the waveform memory 111. Furthermore, the number of channels capable of generating tones is not limited to 128 and may be any other suitable number, such as 64, 80 or 160, under various conditions that may become bottlenecks as discussed above.

Furthermore, whereas the embodiment of the present invention has been described in relation to the case where a two-point interpolation process is performed by the interpolation section 507, the interpolation section 507 may perform interpolation between any desired number of points, such as three point or four points. If four-point interpolation is performed, for example, successive four waveform samples are read out per channel from the waveform memory 111 through one readout operation, and thus, the number of channels capable of generating tones may have to be reduced. When a plurality of waveform samples are to be read out from the waveform memory 111, they may be read out at a high speed in the burst mode; the third example has been described as constructed to read out a plurality of waveform samples per channel in the burst mode. Furthermore, the interpolation section 507 may be provided with a waveform sample buffer.

In the above-described embodiment, desired blocks may be integrated together in a one-chip LSI in any one of the following three ways.

(1) Five blocks of the tone generator 113, transfer control section 112, F→DP transfer section 108, DP RAM 109 and DP→M transfer section 110 may be integrated in a single chip. The waveform memory 111 is constructed by another chip. In this case, it is necessary to perform waveform sample writing and reading to and from the waveform memory 111 in the burst mode to increase the writing and reading speed.

(2) Six blocks of the tone generator 113, transfer control section 112, F→DP transfer section 108, DP RAM 109, DP→M transfer section 110 and waveform memory 111 may be integrated in a single chip. In this case, the waveform memory 111 in the single chip can achieve waveform sample writing and reading at a sufficiently high speed, and thus, the waveform sample writing and reading need not be performed in the burst mode.

(3) The number of the blocks to be integrated in a single chip may be increased as desired in accordance with evolution of processing, for example, by incorporating various I/Os and CPU into a single chip.

In the above-described embodiment, each waveform data is stored in successive pages of the NAND-type flash memory. Alternatively, desired waveform data may be stored distributively in non-successive pages of the NAND-type flash memory. Furthermore, the functions performed by the C address generation section and transfer queue (register) may be performed by the CPU as interrupt processes using a transfer request signal as an interrupt signal.

This application is based on, and claims priority to, JP PA 2009-069357 filed on 23 Mar. 2009. The disclosure of the priority application, in its entirety, including the drawings, claims, and the specification thereof, is incorporated herein by reference.

What is claimed is:

1. A tone generation apparatus comprising:

a non-volatile first memory storing therein series of sample data of a plurality of waveform data, said first memory being capable of burst readout on a page-by-page basis, each of the pages comprising a plurality of sample data, the series of sample data of each of the waveform being stored in a plurality of successive pages in said first memory;

a second memory including a leading waveform region prestoring the sample data of first pages of individual ones of the plurality of waveform data, and a buffer region that sequentially buffers the sample data of pages, succeeding the first page, of the waveform data to be sounded;

a control register which, in response to a tone generation start for given waveform data, registers a leading waveform address indicating a portion of the leading waveform region, in said second memory, corresponding to the given waveform data of the plurality of waveform data, and second-page position information indicative of a stored position, in said first memory, of a second page following said first page;

a readout control section which, in response to the tone generation start instruction, first reads out, at a given readout rate, the sample data of the first page stored in the portion of the leading waveform region indicated by the leading waveform address registered in said control register and then reads out, at a given readout rate, the sample data of the succeeding pages from the buffer region, said readout control section outputting information indicative of a progression of readout;

a page address generation section which, on the basis of the second-page position information registered in said control register and said information indicative of a readout progression outputted from said readout control section, generates page address information that increments, with the second-page position information used as an initial value, in accordance with a progression of readout by said readout control information; and a transfer control section which instructs said first memory to burst read out the sample data of one of the second and succeeding pages in accordance with the page address information generated by said page address generation section and writes, into the buffer region of said second memory, the sample data of the page burst read out from said first memory in response to the instruction given by said transfer control section.

2. The tone generation apparatus as claimed in claim 1, which further comprises a CPU, and wherein, under control of the CPU, said tone generation start instruction for generating a tone of given waveform data is given and the leading waveform address and the second-page position information are written into said control register, and said control register, said readout control section, said page address generation section and said transfer control section are hardware independent of said CPU.

3. The tone generation apparatus as claimed in claim 2, wherein said readout control section includes a counter incremented in accordance with the given readout rate, and sample data readout from said second memory is caused to progress in accordance with count values of the counter, and wherein the counter is hardware independent of the CPU.

4. The tone generation apparatus as claimed in claim 1, which is designed to generate a tone in each of a plurality of channels, and wherein said second memory includes the leading waveform regions and the buffer regions provided in corresponding relation to the plurality of channels, for each of the channels, said second memory registers, in response to a tone generation start instruction for the channel, registers the leading waveform address and the second-page position information pertaining to the waveform data of a tone to be generated in the channel, for each of the channels, said readout control section controls, in response to the tone generation start instruction for the channel, controls readout of the sample data of the first page and the succeeding pages and outputs information indicative of the progression of readout of the channel, for each of the channels, said page address generation section generates the page address information, and for each of the channels, said transfer control section writes the waveform data of a page burst read out from said first memory into the buffer region of said second memory.

5. The tone generation apparatus as claimed in claim 1, which is designed to generate a tone different in each of a plurality of channels, and which further comprises:

a performance information supply section which supplies performance information; and a control section which, in accordance with the performance information supplied by said performance information supply section, assigns, from among the plurality of channels, a channel that should generate a tone corresponding to the performance information, and which generates a tone generation start instruction and a tone generating parameter corresponding to the performance information in correspondence with the assigned channel, the tone generating parameter including at least rate information corresponding to a pitch of the tone to be generated, the leading waveform address of the waveform data to be used for generation of the tone, the second-page position information of the waveform data to be used for generation of the tone, and amplitude control information defining an amplitude of the tone to be generated, and wherein, in accordance with the tone generation start instruction and tone generating parameter generated by said control section, said control register registers at least the rate information, the leading waveform address, the second-page position information and the amplitude control information into a region thereof corresponding to the channel, for each of the channels, said readout control section includes a counter that not only generates a count value incrementing at a rate indicated by the rate information in response to a tone generation start instruction, but also generates a transfer instruction each time the count value progresses one page, wherein, for each of the channels, said readout control section first reads out the sample data of the first page from said second memory and then reads out the sample data of the succeeding pages from the buffer region, in response to the count value of the pitch counter, for each of the channels, said page address generation section generates the page address information in accordance with the second-page position information and the count value, and said transfer control section includes a transfer cue register that, in response to the tone generation start instruction and the transfer instruction, sequentially takes in a channel number and the page address information of a channel related to the tone generation start instruction, wherein said transfer control section sequentially takes out, from the transfer cue register, the taken-in channel number and page address information in a first-in-first-out manner, burst reads out, from said first memory, the sample data of a page indicated by the page address information, and writes the read-out sample data into the buffer region of the channel indicated by the taken-out channel number.

6. The tone generation apparatus as claimed in claim 5, which further includes, for each of the channels, an amplitude control section that controls an amplitude of the sample data, read out by said readout control section, in accordance with the amplitude control information.

7. The tone generation apparatus as claimed in claim 1, wherein said second memory is capable of burst writing and constructed in an integrated circuit independent of said transfer control section, and writing, by said transfer control section, of the sample data of one page into said second memory, is executed by burst writing.

8. The tone generation apparatus as claimed in claim 1, at least said second memory and said transfer control section are implemented by being integrated into a single integrated circuit.

9. The tone generation apparatus as claimed in claim 1, wherein said first memory is a NAND-type flash memory.

10. The tone generation apparatus as claimed in claim 1, wherein said transfer control section includes an intermediate buffer capable of storing the sample data of one page, and said transfer control section stores the sample data, burst read out from said first memory, into the intermediate buffer and writes the sample data, stored in the intermediate buffer, into the buffer region of said second memory.

* * * * *